US006379568B1

(12) United States Patent
Baik et al.

(10) Patent No.: US 6,379,568 B1
(45) Date of Patent: Apr. 30, 2002

(54) DIAMOND FIELD EMITTER AND FABRICATION METHOD THEREOF

(75) Inventors: Young-Joon Baik; Joo-Yong Lee; Dong-Ryul Jeon, all of Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/570,958

(22) Filed: May 15, 2000

Related U.S. Application Data

(62) Division of application No. 09/149,955, filed on Sep. 9, 1998, now abandoned.

(30) Foreign Application Priority Data

Sep. 23, 1997 (KR) ..... 97-48254

(51) Int. Cl.[7] ..... H01J 19/00

(52) U.S. Cl. ..... 216/11; 216/24; 216/51; 216/52; 216/67

(58) Field of Search ..... 313/309, 310, 313/336, 351, 495, 496, 497; 427/577; 216/11, 24, 41, 51, 52, 67

(56) References Cited

U.S. PATENT DOCUMENTS 5,580,380 A * 12/1996 Liu et al. ..... 117/86
5,757,344 A * 5/1998 Miyata et al. ..... 345/75
5,825,126 A * 10/1998 Kim ..... 313/497
5,959,400 A 9/1999 Niigaki et al. ..... 313/495
6,084,338 A * 7/2000 Bojkov et al. ..... 313/309
6,204,595 B1 * 3/2001 Falabella ..... 313/308
2001/0047931 A1 * 12/2001 Xie et al. ..... 204/192.11

OTHER PUBLICATIONS

"Effect of Surface Pretreatments on Nucleation and Growth of Diamond Films on a Variety of Substrates", A.A. Mosish and P.E. Phersson, Appl. Phys. Lett., 52, 417 (1991).

"Patterned polycrystalline diamond microtip vacuum diode arrays"; W.P. Kang, J.L. Davidson, Q. Li, J.F. Xu, D.L. Kinser and D.V. Kerns, 3rd Int. Conf. on Appl. of Diamond Films and Related Materials, NIST, Washington, D.C., p. 37, (1995).

(List continued on next page.)

*Primary Examiner*—Anita Alanko
(74) *Attorney, Agent, or Firm*—Scully, Scott, Murphy & Presser

(57) ABSTRACT

A diamond field emitter and a fabrication method thereof, in which a pretreatment is performed on a surface of an Si substrate in order that diamond nuclei are uniformly formed on the Si substrate during a diamond deposition, an oxide film such as an $SiO_2$ film is deposited on the pretreated surface of the Si substrate and removed after an etching process so that diamond powder can be selectively remained during the etching process, thus the effect of the surface pretreatment of the Si substrate remains in the selected portion during the etching process, and it is also possible to uniformly deposit the diamond in said portion. According to the present invention, the diamond field emitter having excellent and uniform field emission characteristic can be manufactured because the field emission is easily achieved at a tip shaped field emission section, and, moreover, the diamond placed on an upper end portion of the tip increases electron emission effect.

3 Claims, 2 Drawing Sheets

OTHER PUBLICATIONS

"Effect of electric field on the growth of diamond by microwave plasma CVD"; S. Yugo, T. Kimura and T. Muto, Vacuum, 41, 1364 (1990).

"Similarities in the 'cold' electron emission characteristics of diamond coated molybdenum electrodes and polished buck graphite surfaces"; N.S. Xu, Y. Tzeng and R.V. Latham, J. Phys. D26, 1776 (1993).

"Nucleation enhancement behavior of diamond on Si substrate according to surface treatment materials"; B.S. Park and Y.J. Baik, Diamond and related Material, 6, 1716 (1997).

"Vacuum arc discharge preceding high electron field emission from carbon films"; O. Groning, O.M. Kuttel, E. Schaller, P. Groning and L. Schlapbach, Appl. Phys. Lett., 69, 476 (1996).

"Field emission from silicon spikes with diamond coatings"; V.V. Zhirnov, E.I. Givargizov and P.S. Plenkhanov, J. Vac. Sci. and Tech., B13(2), (1995).

"Field emission behavior of (nitrogen incorporated) diamond–like carbon films"; K.–R. Lee, K.Y. Eun, S. Lee and D.–R. Jeon, Thin Solid Films, 290/291, 171 (1996).

* cited by examiner

DIAMOND FIELD EMITTER AND FABRICATION METHOD THEREOF

CROSS REFERENCE TO RELATED APPLICATION

The present application is a divisional of Ser. No. 09/149,955 filed on Sep. 9, 1998 now abandoned.

BACKGROUND OF THE INVENTION

1. Field of the Invention

The present invention relates to a field emitter using a diamond, and in particular to an improved diamond field emitter and a fabrication method thereof, capable of being applied to various uses such as a field emission display (FED) and a vacuum microelectronics, etc.

2. Description of the Conventional Art

Generally, an electron emission effect on a solid surface due to an electric field is a physical feature which enables various application of electron devices including a vacuum microelectronic devices and a microwave devices as well as a field emitter which is a flat-plate devices, etc. It is the most important subject in such various applications to obtain a field emission section having a good capability for emitting electrons when loading the field. The necessary characteristics for an excellent field emission section is that the emission of electrons can be easily and stably generated upon applying low voltage, the electron emission amount should be large, and long durability of the field emitter.

In order to achieve the above objects, developments of the field emission section is currently being processed in two ways. The first method is directed to induce the electron emission by centralizing electric fields at a tip portion which has a higher geometric curvature. The second method is related to utilizing a substance having a small value of a work function which is the necessary energy for discharging the electrons from a solid surface, as a material of the field emission section.

As an example for the former development, a method for fabricating a sharp tip of the field emitter using Si or Mo as a material, and using a dry-etching method or a special deposition method is known. The field emission effect of the field emitter section made according to this method has been confirmed, and such field emitter is currently being studied for applications to field emitting devices [H. F. Gray, Proc. 29th Int. Field Emission Symp., 38, 2355 (1991)].

In the second case, various useful materials for the field emission section have been studied and reported, and a diamond has been discovered as the best material thereamong. The reason is that a diamond has little or no energy barrier to the electrons to be emitted from the solid surface, and also when using the diamond as the material for the field emission section, the characteristic deterioration of the field emission is remarkably minute due to the superior mechanical, thermal and emission proof features of the diamond. In addition, the negative electron affinity of the diamond enables the process of fabricating the field emission section to be simple, because the electron emission is possible even though the diamond is in a flat-plate shape, not a tip shape, and also enable a durability of the field emitter to increase.

As discribed above, since the diamond has the negative electron affinity, the electron emission can be expected even though the field emitter is manufactured in the form of a flat-plate type. However, if the tip section of the field emitter is sharply shaped, a collection effect of electric field is increased, and large amount of the electrons are possibly emitted even when a low voltage is applied. Therefore, various attempts have been performed to accomplish such object. As an example thereof, there has been disclosed a method for coating a thin-film diamond on a tip formed of Si or Mo [N. S. Xu, Y. Tzeng and R. V. Latham, J. Phys. D26, 1776 (1993), V. V. Zhirov, E. I. Givargizov and P. V. Plenkhanov, J.Vac,Sci, and Tech., B13(2), (1995)]. However, in the above method, the density of the diamond nuclei is very low, thus it is hard to uniformly deposit the diamond film thereon, unless a special treatment is carried out on a surface of a substrate before the diamond deposition [A. A. Mosish and P. E. Pehrsson, Appl. Phys. Lett., 59, 417 (1991)], and it is difficult to uniformly coat the diamond film on the tip because the Si tip is easily broken during the process. Also, in order to increase the density of the diamond nuclei, another method known as a bias enhanced nucleation was provided by Yugo, Kimura, and Muto [S. Yugo, T. Kimura, and T. Muto, Vacuum, 41. 1364 (1990)], which is directed to increasing the density of the diamond nucleus by applying a DC voltage to a substrate in a plasma, however, in this method, it is also difficult to uniformly form the diamond nucleus over a large area. On the other hand, according to a method provided by Zhirnov, Givargizov, and Plenkhanov [V. V. Zhirnov, E. I. Givargizov, and P. S. Plenkhanov, J.Vac.Sci. and Tech., B13(2), (1995)] in which the diamond is deposited on a top of a tip section, but no special method is employed for the diamond nucleus formation, thus it is hard to deposit the diamond on a top of all tip section of the field emitter, and because the Si tip is not obtained by a process employing a conventional Si wafer, it is difficult to produce the apparatus by the above method.

Similarly to the above methods in which the tip of the field emitter is manufactured by using Si or Mo, a study using a method for directly making the tip with the diamond thin film has also been carried out [W. P. Kang, J. L. Davison, Q. Li, J. F. Xu, D. L. Kinser, and D. V. Kerns. 3rd Int. Conf. on Appl. of Diamond Films and Related Materials. NIST. Washington D.C., p37. (1995)]. This is a method in which an Si substrate having a tip-type depressed engraving therein is provided, and after depositing the diamond on the Si substrate, the Si is removed, thereby a diamond tip shaped of an embossed tip can be formed. Although the diamond tip fabricated according to this method is excellent in the field emission characteristic compared with the flat-plate diamond film, there are difficulties in the fabrication process therefor. Specifically, since the diamond tip should have enough thickness to be mechanically support itself in order to prevent the embossed diamond tip from being impaired upon removing Si substrate after the diamond deposition on the Si substrate, thus the thickness of the diamond deposition must be at least hundreds of $\mu$m. In this case, it is difficult to uniformly deposit the diamond on the substrate, and when fabricating an field emitter array, the wiring process therefor is almost impossible to achieve.

Additionally, a fundamental problem with the flat-plate diamond film when used as the field emitter is that sparks are generated between the positive and the negative poles when applying a voltage, thus it becomes impossible to use the flat-plate diamond film as a field emitter [O. Groning, O. M. Kuttel, E. Schaller, P. Groning, and L. Schlapbach, Appl. Phys. Lett., 69, 476 (1996), K. R. Lee, K. Y. Eun, S. Lee, and D. R. Jeon, Thin Solid Film. 290/291, 171 (1996)].

In summary, when utilizing a diamond for a field emitter, it is important to economically fabricate a field emission array using a large Si wafer, and to grantee uniform field emission of the fabricated field emission array. However, the above described conventional methods have several problems, that is, sparks are generated between the diamond's positive and negative poles, and the field emission is not uniformly achieved when employing a diamond field emission array in the form of a flat diode type, and when the tip-type diamond is deposited on the substrate, it is difficult to achieve uniform nucleus formation and uniform deposition, and lastly, it is impossible to economically manufacture the field emission array with a large Si wafer.

SUMMARY OF THE INVENTION

Accordingly, it is an object of the present invention to provide an improved diamond field emitter and a fabrication method thereof, which obviates the problems concerning a collection effect of electric field and a sparks generated due to the tip-type diamond according to the related art, while still utilizing the conventional semiconductor manufacturing processes. Therefore, in the present invention, a further advantage is that the wiring and packaging skills according to the prior art can be applied to the present invention without any additional development therefor and any modification thereof.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
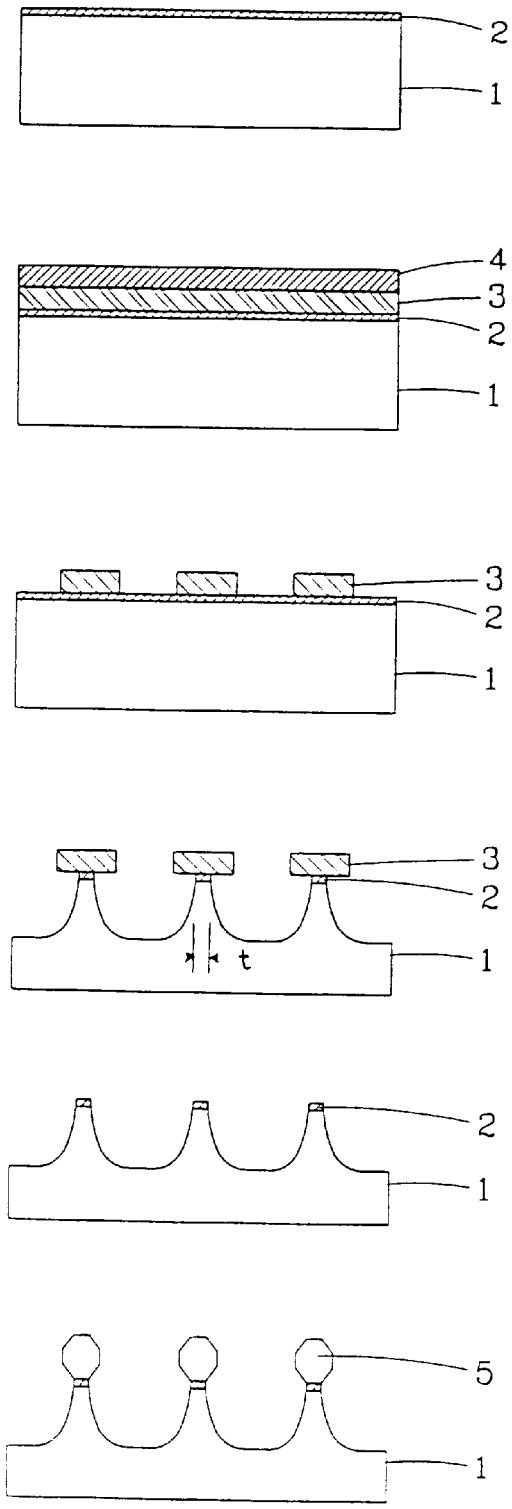
FIG. 1 is a diagram illustrating the processes for fabricating a diamond field emitter according to the present invention.

FIG. 1 illustrates the process for fabricating a diamond electric field emitter and the concept of the same according to the present invention. As shown therein, a first step for fabricating the diamond field emitter of the present invention is a pretreatment process for uniformly forming diamond nuclei on a substrate when depositing the diamond. For this, a surface of an Si wafer 1 is scratched with diamond particles, or the Si wafer 1 is put into a solvent having dispersed diamond powder, and then undergoes an ultrasound treatment therein.

In a second step, in order to fabricate a tip-type field emitter array, an $SiO_2$ film 3 is deposited on a surface-treated layer 2 of the Si wafer 1 and a photo resist film 4 is coated on the $SiO_2$ film 3. The $SiO_2$ film 3 is used because it is important to maintain the effect of the pretreatment for diamond nuclei formation applied to the surface of the Si wafer 1 during the whole fabricating process, since the diamond powder, employed in the first step for the surface treatment of the Si wafer 1 remains on the surface of the Si wafer 1 and acts as the nuclei when depositing the diamond [B. S. Park,Baik and K. Y. Eun, Dia. Rel. Mat., in press (1997)]. Thus, it is important that the diamond powder is selectively remained in the next process and is prevented from being extirpated in an etching process. Therefore, the present invention applies a method in which the $SiO_2$ film 3 is deposited on the surface-treated layer 2 formed on the Si wafer 1 and then removed after the fabricating process is completed, thereby the surface treatment effect may remain on the surface of the Si wafer during the etching process, and by using the above method, it is possible to achieve selective diamond deposition.

The third step comprises making a pattern of an array-type mask, and thereby selectively etching the $SiO_2$ film 3.

The fourth step is for etching an exposed surface of the Si wafer 1 after the selective etching so that the surface-treated layer 2 of the Si wafer 1 has a predetermined width(t) under the selected and thus non-etched part of the $SiO_2$ film 3. Here, the diamond may be deposited on a portion where the Si wafer 1 is etched. In order to prevent such problem, that portion where the Si wafer is etched according to the fourth step should undergo a plasma treatment such as an oxygen treatment, if necessary, as illustrated in the drawing.

In the fifth step, the remaining part of the $SiO_2$ film 3 is removed.

The sixth step is a diamond deposition process, wherein the diamond is only deposited on the unetched portion of the surface-treated Si layer 2 of the Si wafer 1. Accordingly, the diamond may be selectively deposited on a portion required for the electron emission. Since the field emission section has a tip shape, a collection effect of electric field can also be increased. Therefore, while electrons are primarily emitted in a point into which the electric fields are collected, and the diamond in this point multiplies the electron emission effect, thus it can be expected that the massive electrons are generally evenly emitted. In addition, the width (t) of the unetched portion of the surface-treated layer 2 may be varied, so that it is possible to change the degree of the field collection, thereby the field emission effect and field emission density can be adjusted in accordance with various situations. As an extreme case, if the width (t) is determined by a few Å, the similar effect as in the conventional method in which the diamond is deposited on the top of the Si tip can be achieved, thereby settling the above-described problem concerning the fabricating process [N. S. Xu, Y. Tzeng and R. V. Latham, J. Phys. D26, 1776 (1993), V. V. Zhirov, E. I. Givargizov and P. V. Plenkhanov, J.Vac,Sci, and Tech., B13(2), (1995)].

Now, an embodiment of the fabrication method of the diamond field emitter according to the present invention will be described in detail.

First, a N-type single crystal Si substrate with (100) surface direction was put into an acetone solution which was mixed with diamond powder with a diameter under 0.5 $\mu$m, and then an ultrasound treatment was applied to the Si substrate for 2 minutes. A low-pressure chemical vapor deposition (LPCVD) was applied in order to coat an $SiO_2$ oxide film on the resultant Si substrate. Here, the conditions of the process (deposition) were 350 W for the radio frequency power, 390° C. for the substrate temperature, and 9 Torr for the deposition pressure. In addition, traethylorthosilicate (TEOS) was used as a source of the Si, and He 220 sccm and $O_2$ 220 sccm were used as reactant gases, and the deposition speed was 120 Å/sec, and the thickness of the deposited oxide film was 1000 Å.

An AZ 1512 photo resist film was coated on the $SiO_2$ film, and then a desirable pattern of photo resist can be obtained by means of a mask process. Here, the pattern was a square type as a whole formed by arraying a plurality of dots, in particular, 300 dots in width and 300 dots in length, and each of the dot having 2 $\mu$m of a diameter, that the interval between the two dots was 3 $\mu$m.

Next, a dry-etching process was performed to the $SiO_2$ oxide film using the mask of the photo resist film. The condition of the dry-etching process was 130 mbar for the pressure and 600 W for the radio frequency power (RF power). In addition, the flux of the reactant gases was $CHF_4$ 25 sccm, $CF_4$ 54 sccm and Ar 70 sccm, and the etching speed was 60 Å/sec.

Next, the photo resist was removed, and then the Si substrate was etched by using the exposed $SiO_2$ oxide film as a mask. The conditions of the etching process were 600 W for the RF power, 130 mbar for the pressure, 25 sccm of $SF_6$ and 540 sec. for the etching time.

After the above etching process, a gas plasma treatment was performed for 1 hour with the condition of 400 W for the radio frequency power and 0.15 Torr for the pressure.

The $SiO_2$ oxide film which was served as the mask was removed by being put in a 7:1 BHF ($HF:NH_4F$=1:7) solution for 4 min.

Next, the diamond was deposited on the resultant pattern. Here, a microwave plasma assisted chemical vapor deposition (PACVD) was utilized as the deposition process of which conditions were 560 W for the microwave power, 90 Torr for the synthesis pressure, and 960° C. for the deposition temperature. Additionally, the mixture gas containing of 3% $CH_4$ and 97% of $H_2$ was used as a reactant gas.

Figure 2:
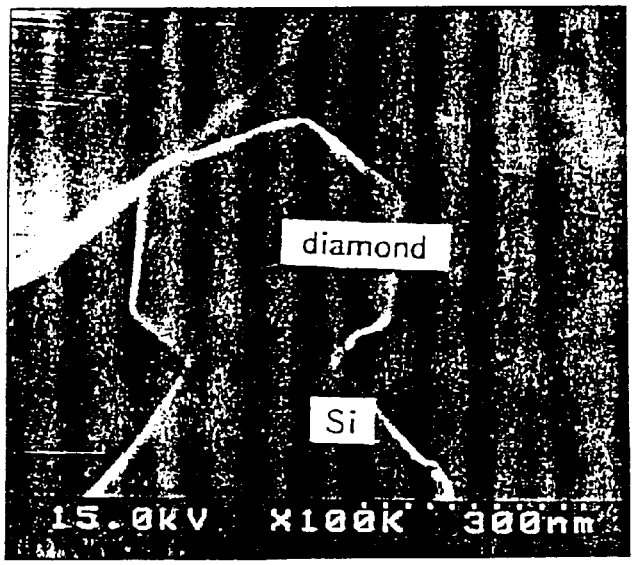
FIG. 2 illustrates the shape of the diamond field emitter fabricated according to the present invention.
Figure 3:
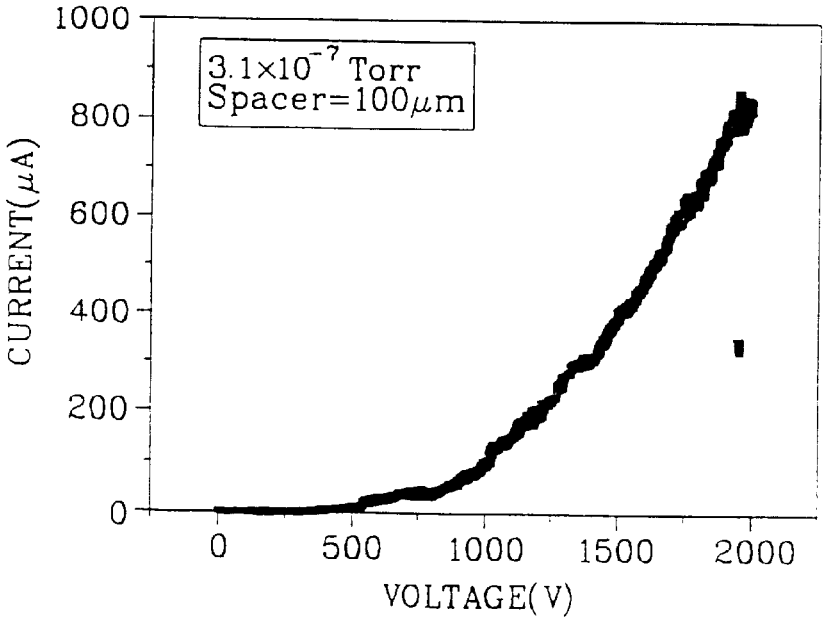
FIG. 3 is a graph illustrating a current(I)-voltage(V) characteristic curve, in that an interval between poles is 100$\mu$m and the degree of vacuum is $3\times10^{-7}$ Torr, measured by an emitter array in FIG. 2.

FIG. 2 illustrates a electric field emission section fabricated according to the present invention. FIG. 3 shows a field emission characteristic curve of an emitter array, in which an interval between the poles are 100 $\mu$m and a degree of vacuum is $3 * 10^{-7}$ Torr. With the field emitter according to the present invention, spark generation among the poles is completely prevented, and as shown in FIG. 3, an excellent field emission characteristic was achieved.

As described above, the diamond field emitter according to the present invention may have the excellent and uniform field emission effect even though a low voltage is applied thereto, and prevents spark generation among the poles. In addition, the wiring and packing skills which are applied to the field emitter array according to the conventional semiconductor manufacturing process are still applicable to the present invention, thereby it is possible to efficiently and economically fabricate a field emitter with a large Si wafer.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. A diamond field emitter fabrication method, comprising:

pretreating a surface of an Si substrate using diamonds;

depositing an $SiO_2$ oxide film on the pretreated Si substrate and coating a photo resist film thereon;

selectively etching the $SiO_2$ oxide film using a mask of a predetermined pattern;

etching a portion of the surface of the Si substrate, which is exposed by said etching of the $SiO_2$ oxide film, so that the pretreated surface of the Si substrate under a portion of the $SiO_2$ oxide film which is not etched has a predetermined width;

performing a plasma treatment for an etched portion of the surface of the Si substrate;

removing the remaining $SiO_2$ oxide film; and depositing a diamond on the pretreated surface of the Si substrate, which is not etched.

2. The method according to claim 1, wherein said pretreatment step comprises scratching the Si substrate with diamond particles.

3. The method according to claim 1, wherein said pretreatment step comprises an ultrasound treatment for the Si substrate in a solution mixed with diamond powder.

* * * * *